US005827439A

United States Patent [19]

Sato et al.

[11] Patent Number: 5,827,439

[45] Date of Patent: Oct. 27, 1998

[54] SUPPLYING METHOD FOR MOLTEN ALLOY FOR PRODUCING AMORPHOUS ALLOY THIN STRIP

[75] Inventors: Yuichi Sato; Shigekatsu Ozaki; Hideya Kuratani, all of Futtsu, Japan

[73] Assignee: Nippon Steel Corporation, Tokyo, Japan

[21] Appl. No.: 771,808

[22] Filed: Dec. 23, 1996

[30] Foreign Application Priority Data

| | | | |
|---|---|---|---|
| Dec. 27, 1995 | [JP] | Japan | 7-351225 |
| Dec. 27, 1995 | [JP] | Japan | 7-351226 |
| Dec. 27, 1995 | [JP] | Japan | 7-351228 |
| Oct. 8, 1996 | [JP] | Japan | 8-267606 |

[51] Int. Cl.[6] ..... B22D 37/00

[52] U.S. Cl. ..... 222/590; 222/594; 222/602

[58] Field of Search ..... 222/590, 591, 222/594, 602; 266/45, 236, 271; 164/463, 423

[56] References Cited

U.S. PATENT DOCUMENTS

| | | | |
|---|---|---|---|
| 3,465,811 | 9/1969 | De Coye De Castelet | 222/602 |
| 5,063,988 | 11/1991 | Follstaedt et al. | 164/463 |
| 5,178,205 | 1/1993 | Fukase et al. | 222/594 |

FOREIGN PATENT DOCUMENTS

| | | |
|---|---|---|
| 1-34550 | 2/1989 | Japan . |

*Primary Examiner*—Scott Kastler
*Attorney, Agent, or Firm*—Kenyon & Kenyon

[57] ABSTRACT

A method for supplying molten metal alloy for producing thin amorphous metal wire or thin amorphous metal strip by liquid quenching and solidification on a moving cooling substrate controls the flow of molten metal from a ladle into a tundish. The ladle has a long nozzle with an interior passage for providing flow of molten metal alloy into the tundish. The ladle stopper has a distal end region received by the interior passage of the long nozzle. Control of the overlap between the distal end region of the ladle stopper received in the long nozzle during molten alloy flow and control of the sectional flow area provided in the long nozzle interior passage controls the flow quantity of molten alloy from the ladle into the tundish.

5 Claims, 8 Drawing Sheets

SUPPLYING METHOD FOR MOLTEN ALLOY FOR PRODUCING AMORPHOUS ALLOY THIN STRIP

BACKGROUND OF THE INVENTION

1. Field of the Invention

The present invention is directed to a liquid quenching method for manufacturing an amorphous metal wire or thin strip (hereinafter "thin strip") by quenching and solidifying a molten alloy on a moving cooling substrate. More particularly, the present invention relates to a method for supplying molten alloy from a ladle storing the molten alloy to a tundish.

2. Description of the Prior Art

Liquid quenching methods for producing thin strips include, for example, the single roll method which discharges a molten alloy on to a single cooling roll rotating at a high speed resulting in the manufacture of a thin strip. In the twin roll method, the molten alloy is discharged between a pair of cooling rolls rotating at a high speed resulting in the manufacture of a thin strip.

A liquid quenching method which uses a single roll cooling/solidification apparatus, as shown in FIG. 7, will be explained. Molten alloy 6 is poured into a tundish 5 so that the level of the molten metal becomes constant. Twyer bricks 9 are disposed on the bottom wall of this tundish 5. An intermediate nozzle 10 and a nozzle holder 11 are interconnected to a passage 13 bored in these twyer bricks 9 to provide a fluid path for the molten alloy. An expanded internal space 14 is located inside the nozzle holder 11. A nozzle chip 12 is fitted to the distal end of the nozzle holder 11, and a nozzle slit 15 is inserted inside this nozzle chip 12 for discharging molten alloy onto the chill roll 8. The expanded internal space 14 inside the nozzle holder 11, the nozzle chip 12 and the nozzle slit 15 are illustrated in FIG. 8. Here, the expanded internal space 14 represents an expanded portion of the molten metal passage 13 inside the nozzle holder 11 so as to obtain a thin strip having a large width. The nozzle slit 15 provides an opening for jetting the molten metal flowing through the nozzle chip 12.

When a tundish stopper 4 is moved up, the molten alloy 6 inside the tundish 5 is allowed to flow through the molten metal passage 13 and is jetted from the nozzle slit 15 onto the cooling roll 8. At this time, the flow rate of the molten alloy 6 flowing out from the nozzle slit 15 onto the cooling roll 8 is controlled in accordance with the static pressure of the molten metal inside the tundish 5. The molten alloy 6 jetting out from the nozzle slit 15 is rapidly cooled on the surface of the cooling roll 8 and is formed into the thin strip 7.

The cooling roll 8 is illustrated in a small scale compared with the large scale of the tundish 5 in FIG. 7 in order to make the entire apparatus more easily understood.

In order to obtain the thin strip by either of the liquid quenching methods described above, the cooling rate must be set to at least about $10^2$ K/sec. Therefore, there is a limitation on the sheet thickness of the resulting thin strip. It is as small as less than about 0.1 mm. When the thin strips having a thickness of less than 0.1 mm are produced by the liquid quenching method, there are differences in the limiting conditions of the various production factors in comparison with ordinary ingot casting methods and continuous casting methods according to conventional solidification technologies. The most important limiting condition is the feed quantity of the molten alloy. In the case of the continuous casting methods for steels, etc., that have been ordinarily employed, the quantity of the molten alloy that can be provided to a casting mold is several tons per minute. A greater quantity of molten alloy can be provided in ordinary ingot casting methods.

In contrast, in the liquid quenching method which is the subject of the present invention, the feed quantity of the molten alloy must be reduced to a very small quantity of not greater than 100 kg/min. This is because of the limitation on the thickness of the thin strip. The maximum strip thickness that can be ordinarily obtained by the single roll method, for example, is about 0.1 mm. The peripheral speed of the cooling roll in this case is about 10 m/sec and the maximum width of the thin strip is about 200 mm. In the case of alloys containing iron as the principal component, the feed quantity of the molten alloy must be controlled to about 90 kg/min.

When the thin strip is produced by the liquid quenching method in an industrial practice, it is a very important to minimize the feed quantity of the molten alloy.

In the case of a conventional continuous casting method, for example, the molten alloy is supplied from a ladle to the casting mold through a tundish. In this instance, a system using a ladle stopper fitted to a long nozzle hole at the bottom of the ladle is employed as one of the methods of controlling the feed quantity of the molten alloy. In other words, the feed quantity of the molten alloy is controlled by moving the ladle stopper up and down, thereby controlling an opening area of the long nozzle. Since a conventional continuous casting method can supply a large quantity of the molten alloy such as several tons per minute as described above, the feed quantity can be easily controlled by such a stopper system.

In contrast, in the case of the liquid quenching method, which is the object of the present invention, the feed quantity of the molten metal must be limited to not greater than 100 kg/min. Therefore, it becomes difficult to employ, as such, the stopper system described above. Japanese Unexamined Patent Publication (Kokai) No. 1-34550, for example, proposes a method which uses the stopper system in the liquid quenching method. Though this method is not limited to the production of the amorphous alloy thin strip, it is devised so as to reduce the relative feed quantity of the molten alloy. It measures the weight of the molten alloy inside the tundish during charging and controls the up or down moving speed of the ladle stopper and the ladle stopper position on the basis of this measurement so as to control the feed quantity of the molten alloy. This method limits the lower limit of the moving distance of the ladle stopper to 2 mm and the upper limit to 6 mm. It can control the feed quantity of the molten alloy with a very high level of accuracy.

According to this method, however, the weight of the tundish must be measured during charging and hence, the control becomes complicated. Further, because a measuring instrument and a computer must be installed, the setup cost becomes high and thus the production cost becomes high. If the moving distance of the ladle stopper is limited to an excessively small value, the operation becomes more difficult because most installations are not free from vibrations no matter how precise they may be. Because of vibration problems, the moving distance of the ladle stopper must be at least about 5 mm.

SUMMARY OF THE INVENTION

It is an object of the present invention to provide a simple and economical method for supplying a molten alloy for producing a thin strip which solves the problems encountered in the feed control of the molten metal in the conventional liquid quenching method by specifying the correlation between a long nozzle and a stopper.

The gist of the present invention resides in the following points.

The present invention is directed to method for supplying molten alloy to a moving cooling substrate for producing an amorphous metal wire or an amorphous metal thin strip.

A ladle is provided for receiving the molten alloy, with the ladle having a bottom wall defining a bottom surface of the ladle. A long nozzle is provided having a length and having an interior passage therein extending the length of the long nozzle. The length of the interior passage extends in a perpendicular direction or inclined to the perpendicular direction. The long nozzle has one end connected to the bottom wall of the ladle placing the interior passage of the long nozzle in fluid communication with the molten alloy in the ladle. A ladle stopper is provided disposed within the ladle. The ladle stopper has an outer wall surface parallel to the perpendicular direction. A tundish is provided below the ladle and in fluid communication with the long nozzle for receiving molten alloy from a distal end of the interior passage of the long nozzle.

Molten alloy is supplied from the ladle to the tundish by feeding molten alloy via the interior passage of the long nozzle.

Molten alloy is supplied from the tundish to the moving cooling substrate.

The ladle stopper is provided with a distal end region having a length which is received by the interior passage of the long nozzle at the one end of the long nozzle.

A distance (y) is defined as an overlap distance of the length of the distal end region of the ladle stopper received by the interior passage of the long nozzle during flow of the molten alloy through the interior passage.

An opening area (Ao) is defined which is a sectional area for molten alloy flow provided by the opening area in the interior passage of the long nozzle resulting from receiving the distal end region of the ladle stopper.

A distance (Ln) is defined as the distance from the bottom surface of the ladle to the minimum cross-sectional area of the interior passage of the long nozzle.

A distance (Lm) is defined as the distance from the bottom surface of the ladle to a height of molten alloy in the ladle at start of feed of the molten alloy.

When (y) is less than 0.1 mm, Ao is set to be 1.2 $cm^2$ and a ratio (Ln)/(Lm) is set be at least 1.5. When (y) is 0.1 to 200 mm, Ao is set to be 0.5 to 10 $cm^2$.

In another embodiment of the present invention, feed of molten alloy is started from the ladle to the tundish by moving the ladle stopper upward a selected distance thereby placing the ladle stopper in a selected position. The ladle stopper is maintained in the selected position until feeding of the molten alloy is completed.

In a further embodiment of the present invention, the distal end region of the ladle stopper is a protrusion having a length of at least 5 mm and having an outer wall surface, with the outer wall surface of the protrusion being parallel to the perpendicular direction. The interior passage of the long nozzle has an inner wall surface. The outer wall surface of the protrusion does not contact the inner wall surface of the interior passage when the protrusion is received by the interior passage.

In still a further embodiment of the present invention, the distal end region of the ladle stopper is a protrusion having a length of at least 5 mm and having an outer wall surface, with the outer wall surface of the protrusion being parallel to the perpendicular direction. The interior passage of the long nozzle has an inner wall surface. A portion of the outer wall surface of the protrusion contacts the inner wall surface of the interior passage when the protrusion is received by the interior passage.

In yet another embodiment of the present invention, the interior passage of the long nozzle has an inner wall surface and at least one obstacle to molten alloy flow is disposed on the inner wall surface of the interior passage.

DESCRIPTION OF THE PREFERRED EMBODIMENTS

The present invention will be explained in detail with reference to the accompanying drawings.

Figure 1:
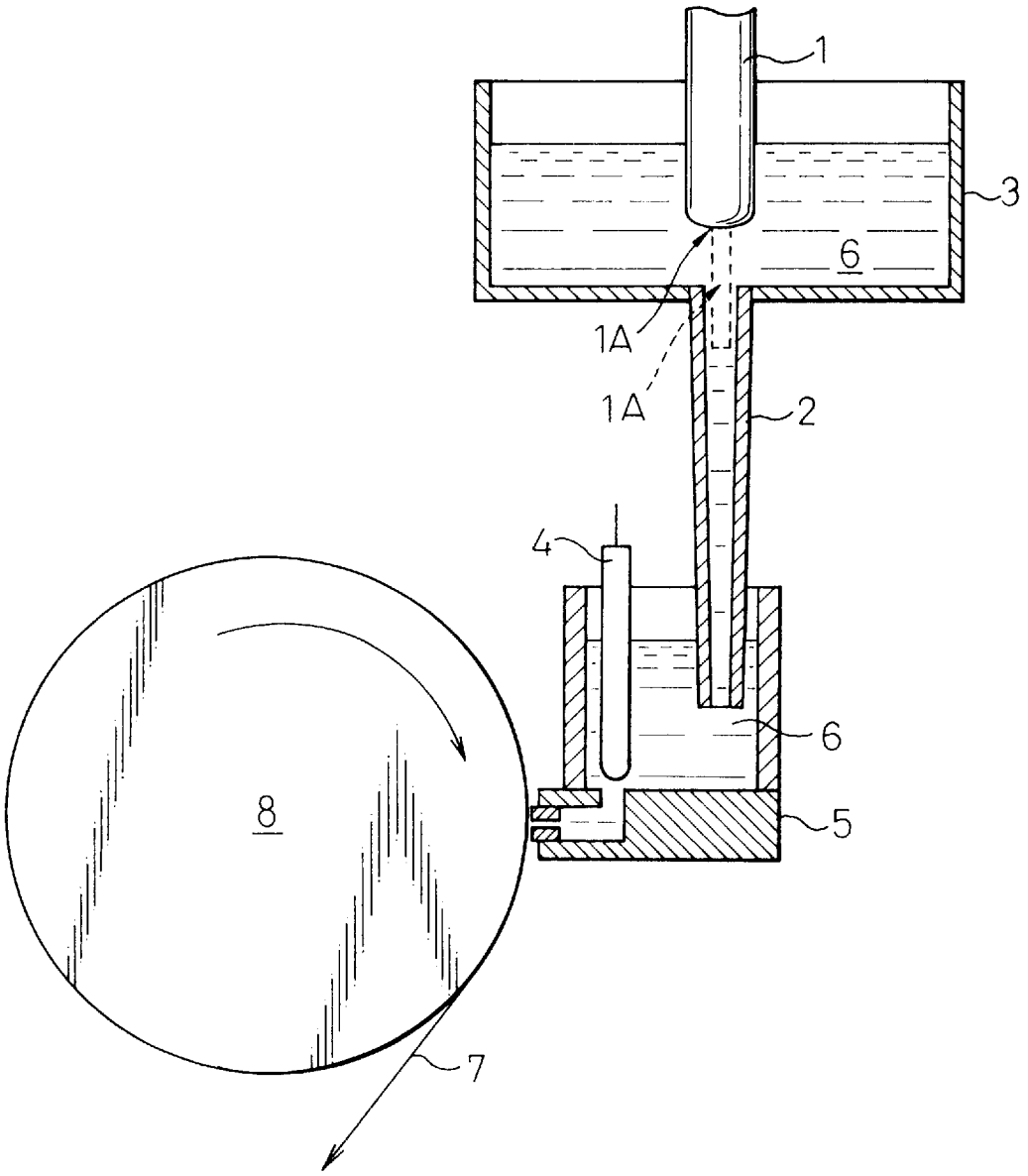
FIG. 1 is a schematic view showing an apparatus used for practicing the method of the present invention.

FIG. 1 is a schematic view showing an apparatus for the production of thin strip amorphous metal used for practicing the method of the present invention. A molten alloy held inside a ladle 3 is supplied to a tundish 5 by raising a ladle stopper 1 through a long nozzle 2. Next, the molten alloy is ejected at a high speed from a nozzle 7 and impinged onto a cooling roll 8 rotating at a high speed so as to form an amorphous thin strip 7. The flow of molten alloy is controlled by an opening/closing operation of tundish stopper 4 disposed inside the tundish.

The inventors of the present invention conducted intensive studies on methods of uniformly and stably supplying a molten alloy at a rate below 100 kg/min. The present inventors discovered that the feed quantity of the molten alloy depends on the length of an overlap portion between the distal end of the ladle stopper and the long nozzle. The present inventors also discovered that the feed quantity of the molten alloy depended upon the shape of the distal end of the ladle stopper and upon the area of opening defined between the ladle stopper and the long nozzle.

The resistance at the time of passage of the molten alloy can be changed by using a stopper having a thin protrusion of a length of 5 mm at the distal end portion thereof as the ladle stopper. An overlap portion is provided in the horizontal direction between the distal end of the ladle stopper and the long nozzle and this overlap portion is changed. By this method, the feed quantity of the molten alloy can be controlled. If the protrusion at the distal end of the ladle stopper is elongated, the overlap portion can be set to a predetermined length even when the moving distance of the ladle stopper is large. As a consequence, even when the moving distance of the ladle stopper is increased to at least 5 mm, the feed quantity of the molten alloy can be stably reduced to a rate not greater than 100 kg/min by combining and controlling the overlap portion and the opening area (Ao) defined by this overlap portion.

When the length of this overlap portion is small, however, setting of the opening area (Ao) can be controlled in the following manner. In such a case, the set position of the opening area (Ao) may be shifted below the long nozzle. It is necessary in this case, however, to change the set position of the opening area (Ao) in such a manner as to correspond to the height of the molten metal surface inside the ladle at the start of the feed of the molten alloy.

The feed quantity of the molten alloy can be supplied stably and uniformly at a rate of not greater than 100 kg/min by conducting casting so that:

(1) The opening area (Ao) inside the long nozzle is not greater than 1.2 $cm^2$ and the ratio (Ln/Lm) of the distance (Ln) from the bottom surface of the ladle to the position of the minimum sectional area inside the long nozzle to the height (Lm) of the molten metal level inside the ladle from the bottom surface of the ladle at the start of the feed of the molten alloy is at least 1.5 when the distance (y) of the overlap portion between the distal end portion of the ladle stopper and long nozzle is less than 0.1 mm.

(2) The opening area (Ao) inside the long nozzle is 0.5 to 10 $cm^2$ when the distance (y) is from 0.1 to 200 mm.

Figure 2A:
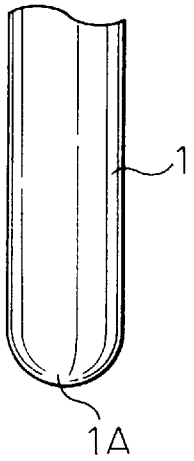
FIGS. 2(*a*) 2(*b*) and 2(*c*) are views showing an example of a ladle stopper equipped with a protrusion that is used in the method of the present invention.
Figure 2B:
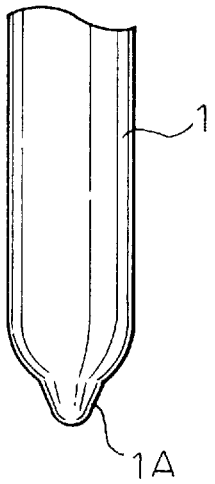
Figure 2C:
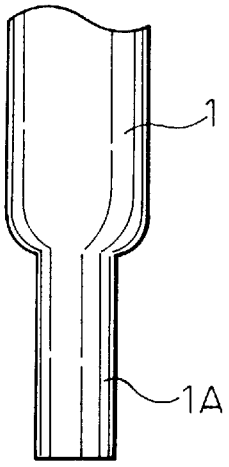

The stopper 1 used in the present invention is equipped with the protrusion 1A at the distal end thereof. This protrusion 1A has a shape corresponding to the intended production condition thin strip. The protrusion may have a small elliptic shape or a rectangular shape as shown in FIGS. 2(*a*) to 2(*c*), by way of example. When the protrusion is rectangular, the outer wall surface of this protrusion is preferably in parallel to the perpendicular direction.

The example where the protrusion 1A is small and elliptic corresponds to case (1) described above. Since in this instance it is difficult to stably set the opening area (Ao) defined by the overlap portion between the distal end of the ladle stopper and the long nozzle to a predetermined value, the opening area (Ao) inside the long nozzle must be set to a value not greater than 1.2 $cm^2$ when the distance (y) of the overlap portion between the distal end of the ladle stopper and the long nozzle is less than 0.1 mm. The ratio (Ln/Lm) of the distance (Ln) from the ladle bottom surface to the minimum sectional area position inside the long nozzle to the height (Lm) of the molten metal level inside the ladle at the start of the feed of the molten metal must be set to at least 1.5.

On the other hand, when the protrusion 1A has a rectangular shape and when the distance (y) of the overlap portion between the distal end portion of the ladle stopper and the long nozzle is from 0.1 to 200 mm, the opening area (Ao) inside the long nozzle must be set to 0.5 $cm^2$ to 10 $cm^2$.

Figure 3:
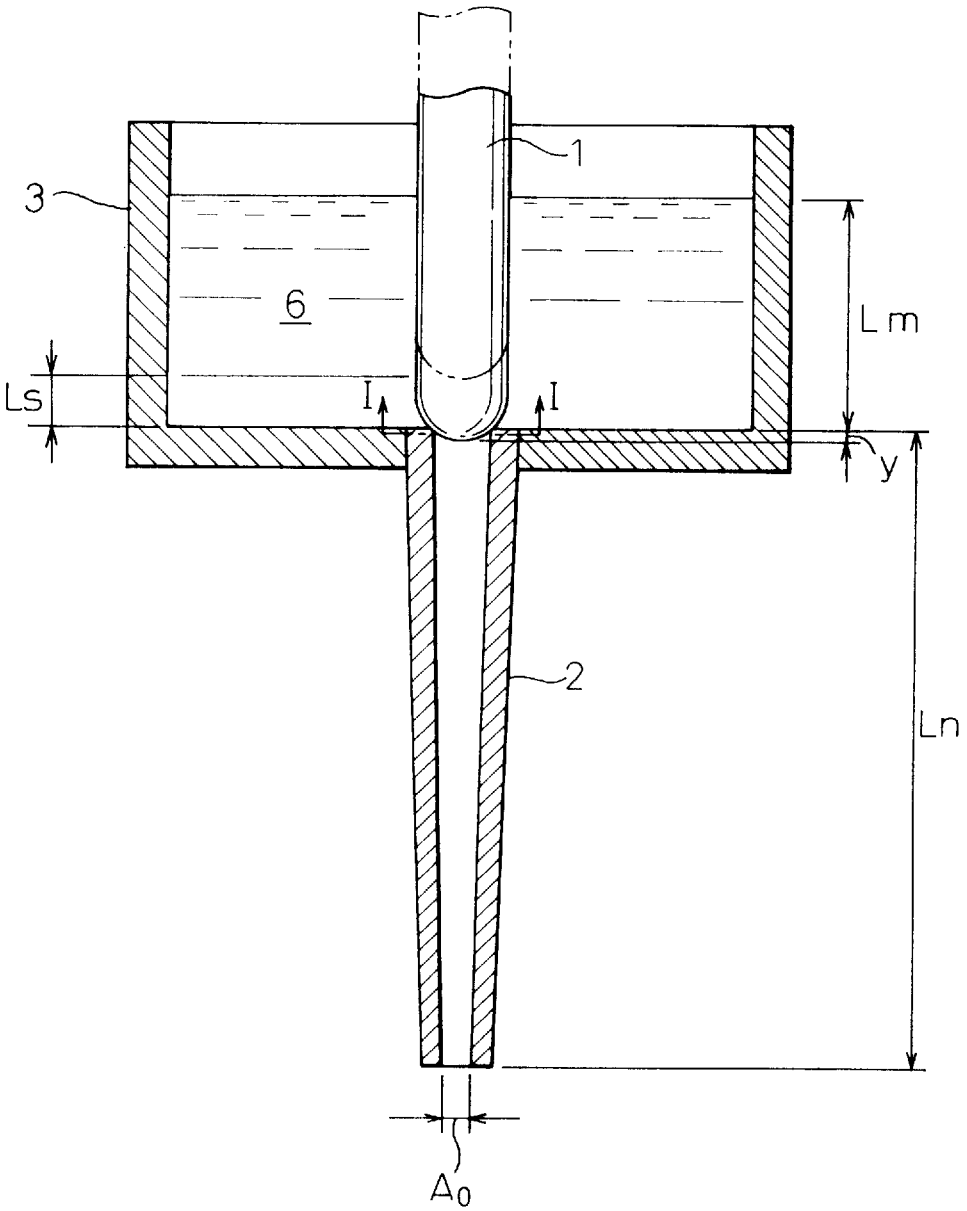
FIG. 3 is a schematic view showing an example of a ladle stopper and a long nozzle used in the method of the present invention.

The inventors of the present invention have carried out experiments and studies by using stoppers having the conventional shapes such as those shown in FIGS. 2(*a*) and 2(*b*) in order to clarify the relationship between the long nozzle opening area and the flow rate of the molten alloy in the conventional method which reduces the flow rate of the molten alloy by reducing the area of the nozzle opening portion at the distal end of this stopper. Fe-B-Si-C system amorphous alloys were primarily used for this experiment. As a result, it has been discovered that in order to set the flow rate of the molten alloy to a value not greater than 100 kg/min by the conventional method, it is necessary to set the opening area (Ao) of the long nozzle to not greater than 1.2 $cm^2$, the distance (y) of the overlap portion between the distal end of the stopper and the long nozzle to less than 0.1 mm and the ratio (Ln/Lm) of the distance (Ln) from the ladle bottom surface to the minimum sectional area position inside the long nozzle to the height (Lm) of the molten metal level inside the ladle at the start of the feed of the molten alloy to at least 1.5, as shown in FIG. 3. It has been further discovered that once the ladle stopper 1 is elevated by a predetermined distance at the start of the feed of the molten alloy, the stopper 1 must be kept at that position until the feed of the molten alloy 6 is completed. It had been believed in the past that the molten metal generates so-called "nozzle clogging" at such a small sectional area. Therefore, the result described above is quite opposite to the common belief.

Here, the term "opening area inside the long nozzle" means the minimum value of the sectional area of the long nozzle inner surface in the horizontal direction. In the case of the long nozzle which is conical and whose sectional area in the horizontal direction decreases in the flowing direction of the molten metal 6 as shown in FIG. 3, for example, the term indicates the inner area (Ao in FIG. 3) of the lowermost portion of the long nozzle 2. The terms "distance (Ln) from the ladle bottom surface to the minimum sectional area position inside the long nozzle" and "height (Lm) of the molten metal level inside the ladle at the start of the feed of the molten alloy" will be explained. First, the term "distance (Ln) from the ladle bottom surface to the minimum sectional area position inside the long nozzle" means the distance (Ln in FIG. 3) in the vertical direction from the bottom portion of the ladle 3 to the lowermost portion of the long nozzle 2 representing the minimum sectional area inside the long nozzle. The term "height (Lm) of the molten metal level inside the ladle at the start of the feed of the molten alloy" means the initial height (Lm in FIG. 3) of the molten alloy 6 held in the ladle 3. The sectional area of the long nozzle shown in FIG. 3 in the horizontal direction progressively decreases in the lower direction. Therefore, the minimum sectional area inside the long nozzle exists at the lowermost portion of the long nozzle. When the distance (y) of the overlap portion between the long nozzle and the distal end portion of the stopper is less than 0.1 mm in the long nozzle used in the present invention, the position of the opening area may be at any position inside the long nozzle if the opening area inside the long nozzle is not greater than 1.2 $cm^2$.

FIG. 3 shows two positions as the stop positions of the ladle stopper. That is, the position before the feed of the molten alloy 6 to the tundish is started and the position at which the molten alloy 6 is being fed. In other words, the solid line represents the former position and the dotted line, the latter position. In the present invention, the ladle stopper 1 is kept fixed at the position indicated by the dotted line while the molten alloy 6 is being fed from the ladle 3 to the tundish. The method of the present invention can keep the feed quantity of the molten alloy constant even when the ladle stopper position is fixed during the feed of the molten alloy. The reason why the feed quantity of the molten alloy can be kept constant even when the ladle stopper is fixed will be described later. Because the position of the ladle stopper can be thus fixed during the feed of the molten alloy, it is no longer necessary to measure the weight of the tundish and to control the feed quantity of the molten alloy by moving the ladle stopper position up and down as has been required in the prior art. Therefore, the molten alloy can be fed easily and economically. Incidentally, the moving distance of the ladle stopper (Ls in FIG. 3) at the start of the feed of the molten alloy is not particularly limited, but a small value is not preferred in consideration of the vibration of the apparatus. The moving distance is preferably from about 5 to about 50 mm.

The inventors of the present invention have also discovered that when the ratio (Ln/Lm) of the distance (Ln) from the ladle bottom surface to the minimum opening area position inside the long nozzle to the height (Lm) of the molten metal level inside the ladle at the start of the feed of the molten alloy is set to at least 1.5, thickness fluctuations in the resulting thin strip do not occur. In other words, when the feed quantity of the molten metal changes, the height of the molten metal level of the molten alloy in the tundish changes, and this change of the molten metal level in the tundish directly results in the fluctuation of the jet pressure of the molten alloy impinged onto the cooling roll. Eventually, the fluctuations occur in the sheet thickness of the resulting thin strip. Therefore, the feed quantity of the molten alloy supplied from the ladle must be made as uniform as possible. However, when the ratio (Ln/Lm) of the distance (Ln) from the ladle bottom surface to the minimum sectional area position inside the long nozzle to the height (Lm) of the molten metal level inside the ladle at the start of the feed of the molten alloy is set to at least 1.5, the fluctuations of the strip thickness, which becomes a problem in the resulting thin strip, cannot be observed. This is the reason why the present invention sets the ratio (Ln/Lm) of the distance (Ln) from the ladle bottom surface to the minimum sectional area position inside the long nozzle to the height (Lm) of the molten metal level inside the ladle at the start of the feed of the molten alloy to at least 1.5.

In other words, because the distance (Ln) from the ladle bottom surface to the minimum sectional area inside the long nozzle is set to be greater than the height (Lm) of the molten metal level inside the ladle, the influence of the height of the molten metal level inside the ladle, that affects the feed quantity of the molten alloy, becomes small. When the distance (Ln) from the ladle bottom surface to the minimum sectional area inside the long nozzle becomes at least 1.5 times the height (Lm) of the molten metal level inside the ladle, the influence of the height of the molten metal level inside the ladle that affects the feed quantity of the molten alloy presumably becomes zero. Therefore, in the present invention, no fluctuation occurs in the feed quantity of the molten alloy even when the feed quantity is not controlled by moving the ladle stopper up and down during the feeding operation of the molten alloy. In other words, the ladle stopper can be kept fixed from the start till the end of the feed of the molten alloy. The value of Ln/Lm is preferably somewhat greater that 1.5 provided that this is permitted by the installation space.

If the production of the long nozzle having a minimum sectional area of not greater than 1.2 $cm^2$ is difficult, a long nozzle having a large sectional area is produced in advance as shown in FIGS. 6(*a*) to 6(*e*). Then an obstacle 16 having a varying shape is fitted into this long nozzle so that the resulting long nozzle has a reduced sectional area. The shape of the obstacle 16 include several different types. Examples are: at least one concentric circle obstacle, a spiral like obstacle, several protruded obstacles or porous like bricks. The sectional shape inside the long nozzle is not particularly limited in the present invention. In other words, so long as the minimum sectional area inside the long nozzle is not greater than 1.2 $cm^2$, the sectional shape inside the long nozzle may be round, elliptic, polygonal or flowershaped. Further, the sectional shape inside the long nozzle may change in the flow direction of the molten alloy 6.

According to the prior art, the moving distance of the stopper must be set to an extremely small value of not greater than 2 mm. The term "moving distance of the stopper" means the distance indicated by Ls in FIG. 3 and is the stroke distance (hereinafter called the "stopper stroke") at the time of opening of the stopper for feeding the molten alloy. Most setups are not free from vibration even though they may be of a precision type. In view of vibrations, it is extremely difficult to stably set the stopper stroke to not greater than 2 mm in practical operation. In view of vibrations, the stopper stroke is preferably at least about 5 mm.

Therefore, the inventors of the present invention have examined feeding methods for molten alloys for setting the flow rate of the molten alloy to not greater than 100 kg/min even at a stopper stroke of at least 5 mm. The inventors found that when the long nozzle has a shape such that the inner wall surface of the opening at its upper portion is parallel to the perpendicular direction and the stopper has the protrusion at the distal end thereof whose outer wall surface is in parallel with the perpendicular direction as already described, the long nozzle opening area can be kept constant even when the stopper stroke is increased. When the y value shown in FIG. 4(*a*) is increased to a certain extent, the feed quantity of the molten alloy can be kept below 100 kg/min even when the long nozzle opening area exceeds 1.2 $cm^2$.

The stopper 1 has the protrusion 1A at the distal end thereof, according to the present invention, as shown in FIG. 2(*c*). The outer wall surface of this protrusion 1A is preferably parallel to the perpendicular direction. The distance (y), in FIG. 4(*a*), of the overlap portion between the long nozzle 2 and the stopper protrusion 1A, is set to 0.1 to 200 mm and the opening area of the long nozzle is set to 0.5 to 10 $cm^2$. Moreover, the inner wall surface at the upper part of the long nozzle 2 is, or is not, brought into contact with the outer wall surface of the protrusion of the stopper so as to feed the molten alloy 6 from the ladle 3 to the tundish.

Here, the term "long nozzle upper portion" means the upper end side of the long nozzle. That is, the portion near the end portion of the long nozzle connected to the ladle. More concretely, the term represents the portion within the range of about 200 mm from the uppermost end of the long nozzle towards its lower portion end.

The long nozzle used for the method of the present invention is limited to those which have a shape such that the inner wall surface of this upper opening portion is parallel to the perpendicular direction. The term "inner wall surface of upper opening portion" refers to the inner wall surface of the opening indicated by reference numeral 2A in the sectional view of the long nozzle 2 in the perpendicular direction shown in FIG. 4(*a*). In the long nozzle 2 used for the method of the present invention the inner wall surface 2A of the upper opening portion is in parallel with the perpendicular direction means that the sectional shape of the opening portion of the long nozzle 2 in the horizontal direction has the same shape within the range of about 200 mm from the uppermost end of the long nozzle 2 towards its lower end.

An important feature of the method of the present invention resides in that it uses the stopper 1 having the protrusion 1A whose outer wall surface is in parallel with the perpendicular direction. The arrangement wherein the outer wall surface of the protrusion 1A is in parallel with the perpendicular direction means that the sectional shape of the protrusion 1A in the horizontal direction has the same shape throughout the full length.

Figure 4A:
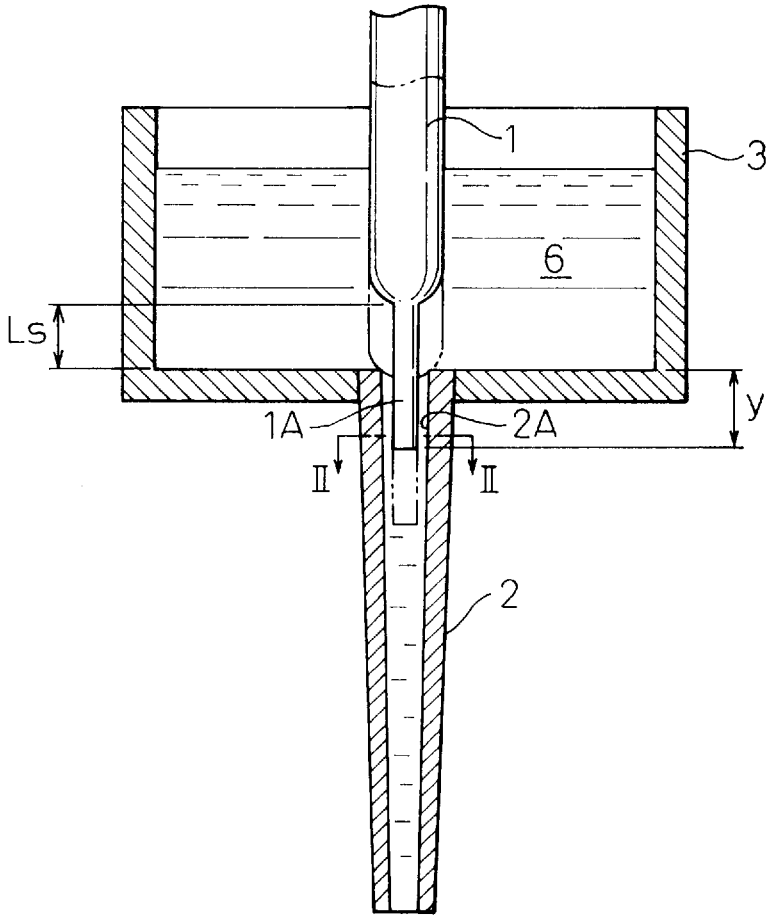
FIG. 4(*a*) is a schematic view and FIG. 4(*b*) is an enlarged schematic view showing an example of a ladle stopper equipped with a protrusion and a long nozzle used in the method of the present invention.
Figure 4B:
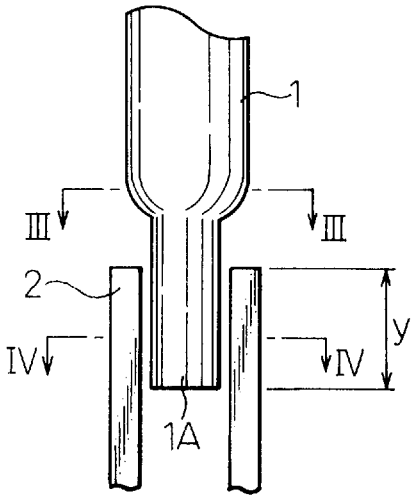
Figure 5A:
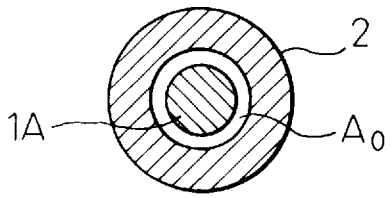
FIGS. 5(*a*) 5(*b*), 5(*c*) and 5(*d*) are sectional views taken along a line I—I of FIG. 3 and a line II—II of FIG. 4(*a*) showing the relationship of an overlap portion between a ladle stopper and a long nozzle used in the method of the present invention, wherein (a) and (b) show a noncontact state and (c) and (d) show a contact state, respectively.
Figure 5B:
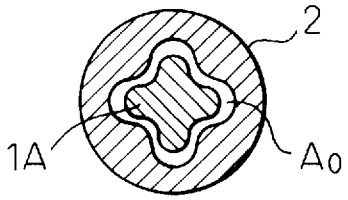
Figure 5C:
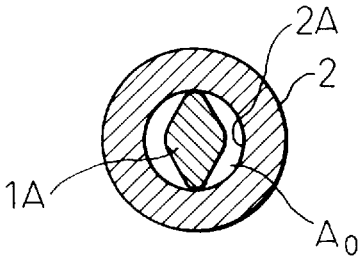
Figure 5D:
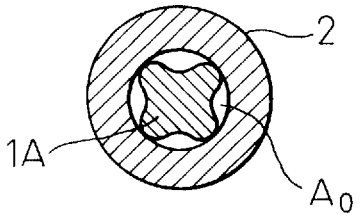
Figure 6A:
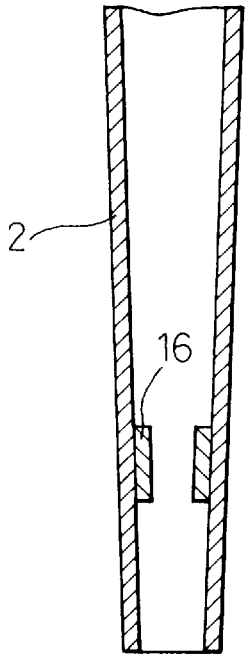
FIGS. 6(*a*) 6(*b*), 6(*c*) 6(*d*) and 6(*e*) are views showing an example where an obstacle is disposed inside a long nozzle used in the method of the present invention.
Figure 6B:
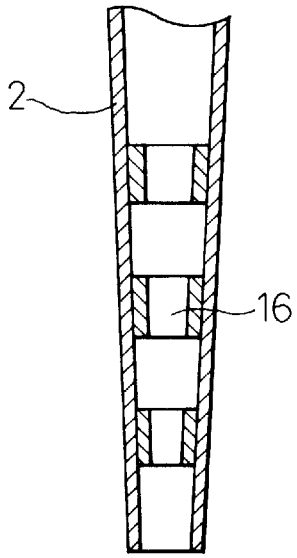
Figure 6C:
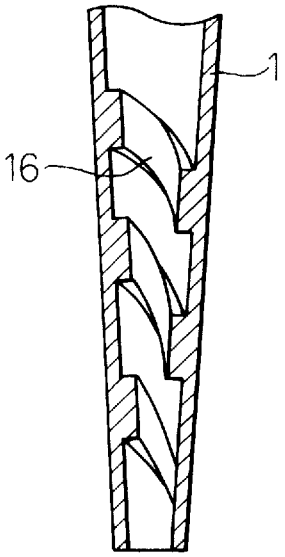
Figure 6D:
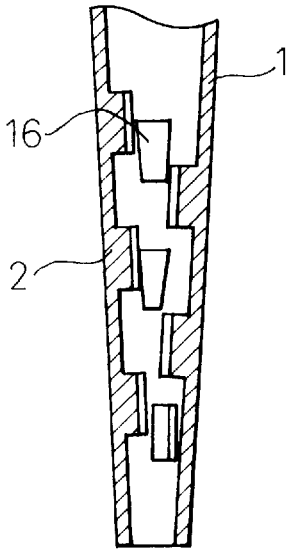
Figure 6E:
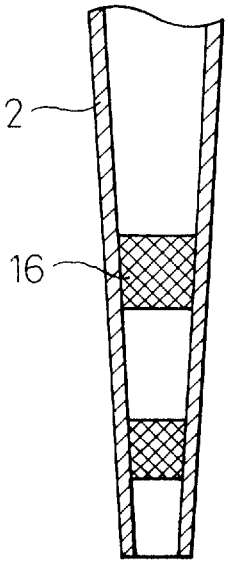
Figure 7:
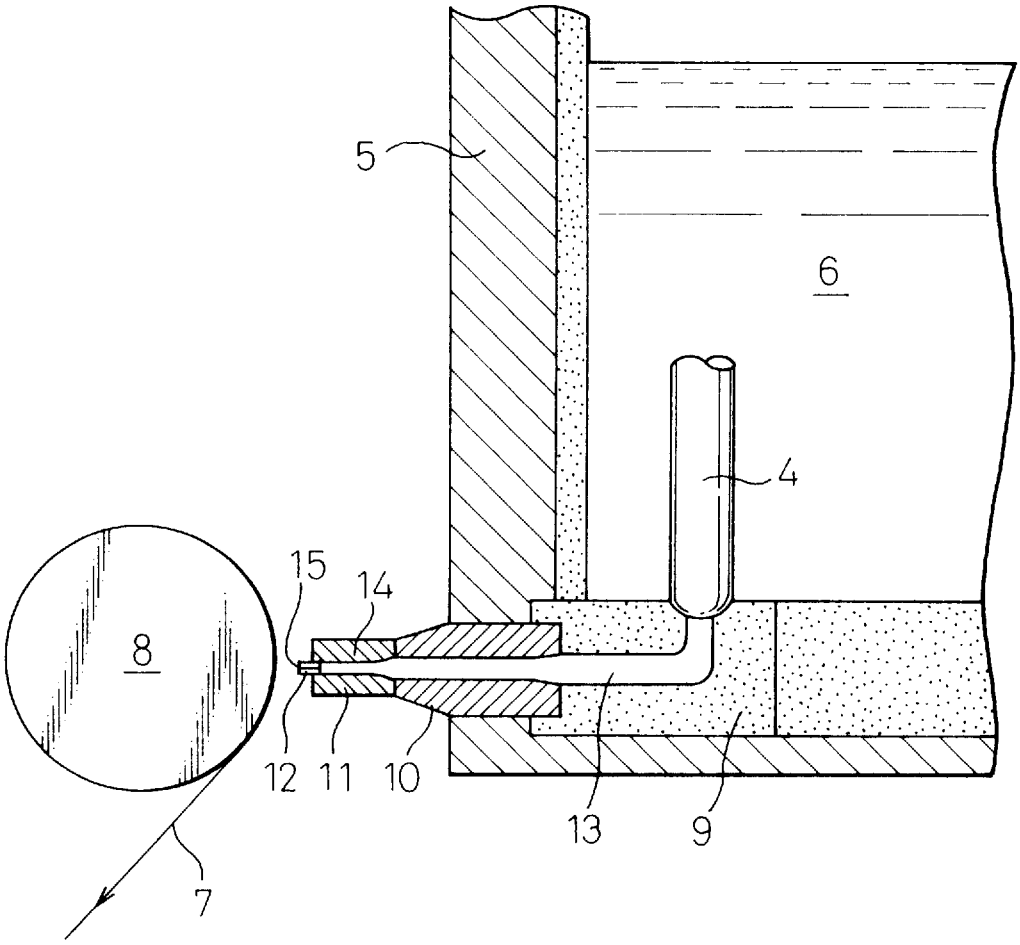
FIG. 7 is a schematic view useful for explaining a single roll quenching/solidification apparatus used to cast a thin strip.
Figure 8:
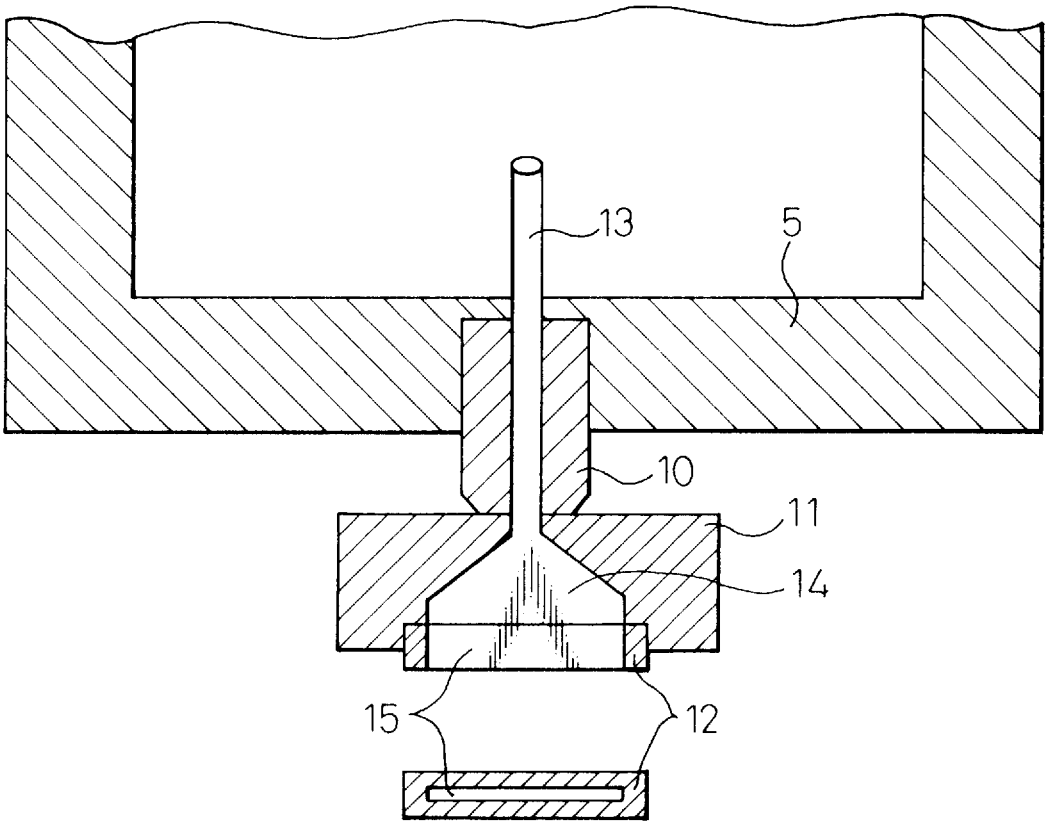
FIG. 8 is an enlarged schematic view useful for explaining a casting state using a single roll quenching/solidification strip production apparatus.

FIG. 4(*a*) and (*b*) show the best feeding method for practicing the method of the present invention. In FIG. 4(*a*), two positions are shown as the stop positions of the ladle stopper 1 used for the method of the present invention. That is, the position before the start of the feed of the molten alloy 6 to the tundish and the position during the feed of the molten alloy 6. In other words, the dotted line represents the former position and the solid line represents the latter position. FIG. 4(*b*) is an enlarged view showing the location near the fitting portion between the ladle stopper 1 and the long nozzle 2 when the ladle stopper 1 is at the position at which the molten alloy is flowing into the tundish. FIG. 5(*a*) is a sectional view taken along a line IV—IV in FIG. 4(*b*). FIG. 4(*a*) illustrates an example where the ladle stopper 1 has a circular cylindrical shape and the long nozzle 2 has a cylindrical shape as illustrated are in FIG. 5(*a*).

The "distance (y) of the overlap portion between the long nozzle 2 and the stopper protrusion 1A" and the "opening area (Ao) of the long nozzle" used in the present method will be explained with reference to FIG. 4(*a*). First, the term "distance (y) of the overlap portion between the long nozzle 2 and the stopper protrusion 1A" is the distance represented by symbol y in FIG. 4(*b*). It is the distance of the area where the protrusion 1A of the ladle stopper 1 overlaps with the long nozzle 2 in the horizontal direction during the feed of the molten alloy. The case where this y value is from 0.1 to 200 mm will be explained in detail.

The term "opening area (Ao) of the long nozzle" is the area represented by symbol Ao in FIG. 5(*a*) to FIG. 5(*d*). It is the sectional area of the space defined by the inner wall surface 2A of the opening at the upper part of the long nozzle and the outer wall surface of the protrusion 1A of the stopper 1. In the method of the present invention, the Ao value is limited to 0.5 to 10 $cm^2$.

In the method of the present invention, the sectional shape of the long nozzle in the horizontal direction is the same as the sectional shape of the protrusion of the stopper in the horizontal direction within the range of the distance y. Therefore, the value of the opening area Ao of the long nozzle has a constant value within the range of the distance y.

The reasons why the distance (y) of the overlap portion between the long nozzle 2 and the stopper protrusion 1A is limited to 0.1 to 200 mm and why the opening area (Ao) of the long nozzle is limited to 0.5 to 10 $cm^2$ in the method of the present invention will be explained.

It has been discovered that even when the y and Ao values shown in FIGS. 3 and 4(*a*), (*b*), and FIGS. 5(*a*) to (*d*) are limited to 0.1 to 200 mm and to 0.5 to 10 $cm^2$, respectively, the feed quantity of the molten alloy is set to a rate not greater than 100 kg/min. This is why the distance (y) of the overlap portion between the long nozzle and the stopper protrusion is limited to 0.1 to 200 mm and the opening area (Ao) of the long nozzle is limited to 0.5 to 10 $cm^2$.

Preferred combinations of the distance (y) of the overlap portion between the long nozzle and the stopper protrusion with the opening area (Ao) of the long nozzle will be illustrated concretely in the later-appearing Examples. Fundamentally, however, when the Ao value is decreased within the range described above, the y value can be decreased within the range described above. Their values may be suitably selected in accordance with a predetermined feed quantity for the molten alloy. If the Ao value is less than 0.5 $cm^2$, however, clogging of the nozzle is likely to occur even though the feed is the amorphous alloy. For this reason, the method of the present invention limits the Ao value to at least 0.5 $cm^2$. On the other hand, the reason why the upper limit of the Ao value is set to 10 $cm^2$ is to place an upper limit on the y value. The reason why the upper limit is placed on the y value is that problems would occur in fitting the stopper or during its opening and closing operations if the y value is excessively large. For these reasons, the y value is limited to not greater than 200 mm. When the y value exceeds 200 mm, centering with the long nozzle becomes difficult and fitting of the stopper also becomes difficult. If centering of the stopper with the long nozzle becomes inferior, the opening and closing operations of the stopper cannot be carried out smoothly. When the y value is set to 200 mm, the Ao value can be increased up to 10 $cm^2$. This is the reason why the upper limit of Ao value is set to 10 $cm^2$.

The reason why the upper limit of y is 200 mm is described above. The reason why the lower limit of y is 0.1 mm is to stably set a predetermined Ao value.

The stopper of the present invention is the stopper for controlling the feed quantity of the molten alloy for producing the amorphous alloy thin strip which is characterized in that the stopper has a thin protrusion, with the length of this protrusion being at least 5 mm. The outer wall surface of the protrusion is in parallel with the perpendicular direction. Here, the term "thin protrusion" means that the protrusion is so thin that it can be fitted into the opening of the long nozzle at the fitting portion with the long nozzle. The length of the protrusion of the stopper is limited to at least 5 mm. The stopper stroke must be at least 5 mm as previously discussed and the y value must be at least 0.1 mm.

The discovery that "the feed quantity of the molten alloy can be set to a rate not greater than 100 kg/min even when the stopper stroke is greater than 5 mm by setting the y and Ao value to 0.1 to 200 mm and to 0.5 to 10 $cm^2$, respectively" was made performing experiments using the Fe-B-Si-C system amorphous alloy. This phenomenon results from the fact that the viscosity of an amorphous alloy in the molten state is far smaller than that of ordinary crystalline alloys. Since this phenomenon does not only occur in the Fe-B-Si-C system amorphous alloy but is believed to occur in a broad range of alloys that can be converted to amorphous alloys, the present invention can be widely applied to a variety of amorphous alloys.

According to the method of the present invention, the molten alloy can be provided supplied at a constant feed rate of not greater than 100 kg/min even when the position of the ladle stopper is fixed once the ladle stopper is moved upward at the time of the start of the feed of the molten alloy. Since the method of the present invention does not require the position of the ladle stopper to be moved up and down so as to control the flow rate of the molten alloy as has been necessary in the prior art, the operation can be carried out easily. Since the present invention does not require a complicated apparatus, it can economically supply the molten alloy.

When the height of the molten metal level in the tundish fluctuates to some extent due to the effect of the decrease of the molten metal level inside the ladle in the present invention, it is advisable to eliminate the fluctuation of the molten metal level in the tundish by inserting a dummy volume, for example, into the tundish and moving up and down this dummy volume in accordance with the fluctuation of the molten metal level of the tundish. A change of the height of the molten metal level in the tundish can cause fluctuation of the jet pressure of the molten alloy impinging on the cooling roll. Eventually, this can cause a fluctuation in the sheet thickness of the resulting thin strip. Thin strips having a large thickness fluctuation generally cause problems when used as industrial materials. The method of inserting the dummy volume into the tundish and keeping constant the height of the molten metal level in the tundish is an economical method and does not significantly increase the production cost of the thin strip.

The present invention does not specifically limit the stopper stroke of the ladle stopper at the start of the feed of the molten alloy. In view of the vibration of the apparatus, it is not preferred to set the stroke to an excessively small value. Preferably, therefore, the range of the stopper stroke is from about 5 to about 50 mm.

FIGS. 4(*a*) and (*b*) show the case where a circular cylindrical long nozzle is used by way of example. However, the shape of the long nozzle used for the method of the present invention is not specifically limited to a circular cylindrical shape. The sectional shape of the long nozzle may be circular, elliptic, flower-like or polygonal. FIGS. 5(*a*) to (*d*) are sectional views taken along a line II—II of FIG. 4(*a*) and line IV—IV of FIG. 4(*b*). FIG. 5(*b*) shows the long nozzle 2 having different shapes on the outside and the inside, that is, a circular outer shape and a flower-like opening shape. Further, the shape of opening of the long nozzle can be different at its upper and lower portions.

The present invention does not particularly limit the sectional shape of the protrusion on the stopper. When the shape of the opening of the long nozzle 2 is flower-shaped as shown in FIG. 5(*b*), for example, the shape of the overlap portion between the stopper 1 and the long nozzle 2 also may be flower-shaped.

Needless to say, the sectional shape of the opening of the long nozzle 2 in the horizontal direction does not have to be similar to the sectional shape of the protrusion 1A of the stopper 1 in the horizontal direction as shown in FIGS. 5(*c*) and 5(*d*), for example. In other words, FIGS. 5(*c*) and (*d*) are sectional views taken along the line IV—IV in FIG. 4(*b*). As can be appreciated from FIG. 5(*c*), the sectional shape of the protrusion 1A may be different in the horizontal direction from the sectional shape of the opening of the long nozzle 2 such as in the combination of the stopper 1 having the protrusion 1A whose sectional shape is elliptic used with a circular cylindrical long nozzle 2.

The preferred thin strip production apparatus used by the present invention is the single roll apparatus or the twin roll apparatus for jetting the molten alloy through the nozzle to the cooling substrate and quenching and solidifying the molten alloy by the thermal contact. The single roll apparatus includes a centrifugal quenching apparatus using the inner wall of a drum, an apparatus using an endless type belt, and improvement types such as those equipped with an auxiliary roll, a roll surface temperature controller, or casting in an inert gas or in vacuum at a reduced pressure.

The casting conditions used for the method of the present invention and specific casting operations will be explained. The jet pressure of the molten metal is 0.01 to 3 kg/cm$^2$. It is set primarily by using the height of the molten metal level inside the tundish. The rotating speed (surface speed) of the cooling roll is within the range of 5 to 60 m/sec. Optimum values are selected for these conditions in accordance with the type of the alloys used, the thickness of the intended strips and other production conditions.

According to one embodiment of the method of the present invention, at least one portion of the outer wall surface of the protrusion of the stopper is brought into contact with the inner wall surface of the opening at the upper portion of the long nozzle during supplying the molten alloy 6 from the ladle 3 into the tundish 5. Here, the term "outer wall surface of the protrusion of the stopper is brought into contact with the inner wall surface of the opening at the upper portion of the long nozzle" represents the state shown in FIGS. 5(*c*). These drawing figures show embodiments where two portions of the outer wall surface of the protrusion 1A of the stopper 1 are in contact with two portions of the inner wall surface 2A of the opening at the upper portion of the long nozzle 2. The term "outer wall surface of the protrusion of the stopper is brought into contact with the inner wall surface of the opening at the upper portion of the long nozzle" represents such a state. When the outer wall portion of the protrusion of the stopper is brought into contact with the inner wall surface of the opening at the upper portion of the long nozzle, centering of the long nozzle with the stopper becomes easier. Therefore working factors during the production of the thin strip can be improved, and the supply of the molten alloy becomes easier.

EXAMPLE 1

The production of a Fe-$B_{12}Si_{6.5}C_1$ (at %) alloy thin strip was carried out by using a single roll thin strip production apparatus as shown in FIG. 1. The molten alloy was in a ladle equipped with a ladle stopper and with a long nozzle as shown in FIG. 3. The ladle stopper used was of an ordinary type having an elliptic distal end (to which a fine protrusion may be attached). The long nozzle was made of alumina graphite and its inner sectional shape was circular. It had an inner diameter of 30 mm at the uppermost portion, an inner diameter of 12 mm at the lowermost portion, and a length of 1 m. The distance (y) of the overlap portion between the distal end portion of the ladle stopper and the distal end portion of the long nozzle was adjusted to 0.08 mm. The opening area inside the nozzle was 1.13 cm$^2$ and the distance (Lm) from the ladle bottom surface to the minimum sectional area position inside the long nozzle was 1 m.

Melting of the alloy was effected by a radio frequency induction system. The height of the molten alloy level inside the ladle before the start of feeding the molten alloy to the tundish was 250 mm. In other words, the height (Ln) of the level of the molten metal inside the ladle at the start of feeding the molten metal was 250 mm and the Ln/Lm value was 4 in this experiment. The ladle stopper used was made of alumina graphite, the same as the long nozzle, and had a cylindrical shape, a length of 800 mm and an outer diameter of 60 mm. A radius of curvature (combination of R 120 mm and R 15 mm) was applied to only the portion having a length of 35 mm at the distal end.

The molten alloy was guided into the tundish by moving up the ladle stopper 20 mm. Immediately thereafter, the production of the thin strip was started by moving up the tundish stopper 20 mm. Both of the ladle stopper and the tundish stopper were kept at the 20 mm elevated positions until the production of the thin strip was completed.

Other thin strip production conditions were as follows. Molten alloy temperature inside ladle at charging: 1,350° C.; nozzle opening shape: opening formed by aligning two rectangular slits having a size of 120 mm×0.7 mm with a 1.5 mm-gap; surface speed of cooling roll at casting: 20 m/sec; gap between nozzle and cooling roll: 0.3 mm.

As a result, a thin strip having a width of about 120 mm and good properties could be obtained. Samples each having a length of 20 m were collected from the resulting thin strip at five positions spaced apart equidistantly in the longitudinal direction. The weight of each sample was measured. The weight was found to be about 0.95 kg for all the samples. Since each 20 m-long sample was the quantity of the thin strip produced within one second, the quantity of the molten alloy supplied to the tundish was about 57 kg/min. The thickness of the resulting thin strip was about 55 $\mu$m. Fluctuation of the thickness in the longitudinal direction of the thin strip hardly existed. The thin strip so obtained was excellent in both magnetic and mechanical properties.

It can be understood from the results described above that the feed quantity of the molten alloy by such a supplying method of the molten alloy was not greater than 100 kg/min and the molten alloy could be uniformly supplied during casting.

EXAMPLE 2

The production of a Fe-$B_{12}Si_{6.5}C_1$ (at %) alloy thin strip was carried out by using a single roll thin strip production apparatus as shown in FIG. 1. The molten alloy was in a ladle equipped with a ladle stopper and a long nozzle as shown in FIG. 4(*a*). The long nozzle used was made of alumina graphite and had a cylindrical shape. It had an inner diameter of 40 mm at the uppermost portion, an inner diameter of 25 mm at the lowermost portion, and a length of 1 m. The inner diameter had a constant value at the portion of a length of 200 mm from the upper-most portion to the lower portion. The lower portion had a predetermined taper. The long nozzle had an outer diameter of 60 mm for the portion having a distance of 200 mm from the uppermost portion towards the lower portion, and the outer diameter was 40 mm at the lowermost portion. The ladle stopper was made of alumina graphite, had a circular cylindrical shape having a length of 860 mm and an outer diameter of 60 mm. It had a circular cylindrical protrusion having a length of 60 mm at the distal end thereof as shown in FIG. 4(*b*). Three kinds of ladle stoppers were used and the diameter of the protrusion at the distal end of each stopper was changed.

Here, the protrusion at the distal end of the stopper and the long nozzle were arranged in such a fashion that they did not come into contact with each other so as to secure the opening area Ao, as shown in FIG. 5(*a*), (*b*).

Melting of the alloy was effected by a radio frequency induction system. The height of the molten metal level inside the ladle before the start of feeding of the molten alloy to the tundish was 250 mm. The casting experiment was carried out with one charge for each of three kinds of ladle stoppers, that is, three charges in total. As the conditions for each casting experiment for each charge, the values of y and Ao shown in FIG. 4(*a*), (*b*) and FIG. 5(*a*), (*b*) and the value of the stopper stroke (Ls) of the ladle stopper were tabulated in Table 1. Other thin strip production conditions were as follows.

Molten alloy temperature inside ladle at charging: 1,350° C.; nozzle opening shape: opening formed by aligning two rectangular slits having a size of 120 mm×0.7 mm with a 1.5 mm gap; surface speed of cooling roll at casting: 24 m/sec; gap between nozzle and cooling roll: 0.25 mm.

As a result, a thin strip having a width of about 120 mm and having excellent properties was obtained. Samples, each having a length of 24 m, were collected from the resulting thin strips at five positions spaced apart equidistantly in the longitudinal direction, and the weight of each sample was measured. Since this weight represented the weight of the molten alloy supplied within one second, the feed quantity of the molten alloy at the time of casting was calculated from this data. The minimum and maximum values were tabulated in Table 1 as the results.

TABLE 1

| | casting condition | | | result | |
|---|---|---|---|---|---|
| | | | | feed q'ty of | strip |
| No | y mm | $A_o$ $cm^2$ | $L_s$ mm | molten alloy kg/min | thickness $\mu$m |
| 1 | 18 | 1.8 | 42 | 69–71 | 53–55 |
| 2 | 28 | 2.4 | 32 | 65–69 | 49–52 |
| 3 | 43 | 3.5 | 17 | 85–88 | 60–63 |

As can be understood from this table, the values of the molten alloy feed quantity from the charge were substantially constant for each charge. The strip thickness of each of the 24 m-long samples collected was measured. The minimum and maximum values of the strip thickness of each sample were also tabulated in Table 1. A great fluctuation in the thickness of the thin strip could not be observed in any charge. It can be understood from this data that no fluctuation which would become a problem from the molten alloy feed quantity occurred in all the charges. The resulting thin strips were excellent in both magnetic and mechanical properties.

It can be understood from the results given above that the supplying method of the molten alloy can supply the molten alloy at a feed quantity of not greater than 100 kg/min and furthermore, substantially uniform during casting.

EXAMPLE 3

Production experiments for thin strips were carried out by using the same thin strip production apparatus as in Example 2. The ladle stopper had a circular cylindrical shape having a length of 900 mm and an outer diameter of 60 mm. It had a circular cylindrical protrusion having a length of 100 mm at the distal end thereof as shown in FIG. 4(*a*), (*b*). Three kinds of ladle stoppers were used, and the diameter of the protrusion at the distal end of each ladle stopper was changed. The casting experiments were carried out by changing the values y and Ao shown in FIGS. 4(*a*), (*b*) and 5(*a*), (*b*). The values y and Ao used for the respective casting experiments were tabulated in Table 2. The surface speed of the cooling roll was set to 26 m/sec, and other casting conditions were the same as those of Example 2.

As a result, thin strips having a width of about 120 mm and good properties could be obtained in all the charges. Samples each having a length of 26 m were collected from the resulting thin strips in the same way as in Example 1. The feed quantity of the molten alloy and the thickness of the thin strips were examined. Table 2 shows the results in the same way as in Table 1. From the data of the feed quantity of the molten alloy and the thickness of the thin strips tabulated in Table 2, fluctuation of the feed quantity of the molten alloy could not be observed in any charge. Fluctuations which would become the problem in the thickness of the thin strips could not be observed.

TABLE 2

| | casting condition | | | result | |
|---|---|---|---|---|---|
| | | | | feed q'ty of | strip |
| No | y mm | $A_o$ $cm^2$ | $L_s$ mm | molten alloy kg/min | thickness $\mu m$ |
| 1 | 62 | 5.5 | 38 | 72–75 | 52–56 |
| 2 | 76 | 6.4 | 24 | 63–65 | 47–51 |
| 3 | 88 | 7.3 | 12 | 66–69 | 49–52 |

It can be understood from the results given above that the supplying method of the molten alloy can supply the molten alloy at a feed quantity of not greater than 100 kg/min and furthermore, is substantially uniform during casting.

EXAMPLE 4

The production of a $Fe\text{-}B_{12}Si_{6.5}C_1$ (at %) alloy thin strip was carried out by using a single roll thin strip production apparatus shown in FIG. 1. The molten was in a ladle equipped with a ladle stopper and with a long nozzle as shown in FIG. 4(*a*). The long nozzle used was made of alumina graphite and had a cylindrical shape as shown in FIG. 4(*a*), (*b*). It had an inner diameter of 40 mm at the uppermost portion, an inner diameter of 25 mm at the lowermost portion and a length of 1 m. The inner diameter had a constant value at the portion of a length of 200 mm from the uppermost portion. The lower portion had a predetermined taper. The long nozzle had an outer diameter of 60 mm for the portion having a distance of 200 mm from the uppermost portion towards the lower portion, and the outer diameter was 40 mm at the lowermost portion. The ladle stopper was made of alumina graphite, had a circular cylindrical shape having a length of 900 mm, an outer diameter of 100 mm, and had an elliptic protrusion having a length of 60 mm at the distal end thereof as shown in FIG. 5(*c*). The major diameter of this elliptic protrusion was 40 mm. The stopper was in slight contact with the inner wall surface of the opening at the upper portion of the long nozzle at two position at both ends of the major diameter. Three kinds of ladle stoppers were used. The minor diameter of the elliptic shape of the protrusion at the distal end of each stopper was changed.

Melting of the alloy was effected by a radio frequency induction system. The height of the molten metal level inside the ladle before the start of the feeding of the molten alloy to the tundish was 250 mm. The casting experiment was carried out in one charge for each of three kinds of the ladle stoppers, i.e., three charges in total. The values of y and Ao shown in FIG. 4(*a*), (*b*) and FIG. 5(*c*) and the value of the stopper stroke (Ls) of the ladle stopper, as the condition of each casting experiment, are tabulated in Table 3. Other thin strip production conditions were as follows.

Molten alloy temperature inside ladle at charging: 1,350° C.; nozzle opening shape: opening formed by aligning two rectangular slits having a size of 120 mm×0.7 mm with a 1.5 mm-gap surface; speed of cooling roll at casting: 24 m/sec; gap between nozzle and cooling roll: 0.25 mm.

As a result, thin strips having a width of about 120 mm and good properties could be obtained in all of the charges. Samples each having a length of 24 m were collected from the resulting thin strips at five positions spaced apart equidistantly in the longitudinal direction. The weight of each sample was measured.

Since this weight represented the weight of the molten alloy supplied for 1 second, the feed quantity of the molten alloy at the time of casting was calculated from this data. The minimum and maximum values of the results were tabulated in Table 3. The feed quantity of the molten metal in the charge was substantially constant for each charge as can be understood from these values. The sheet thickness was measured for each of the 24 m-long samples so collected. The minimum and maximum values of the strip thickness so obtained were also tabulated in Table 3. A great fluctuations could not be observed in the thickness of the thin strip for each charge. It could be understood from this data that no fluctuation which would become a problem resulting from the molten alloy feed quantity occurred in any of the charges. The resulting thin strips were excellent in both magnetic and mechanical properties.

It can be understood from the results given above that the supplying method of the molten alloy can supply the molten alloy at a feed quantity of not greater than 100 kg/min and furthermore, substantially uniformly during casting.

TABLE 3

| | casting condition | | | result | |
|---|---|---|---|---|---|
| | | | | feed q'ty of | strip |
| No | y mm | $A_o$ $cm^2$ | $L_s$ mm | molten alloy kg/min | thickness $\mu m$ |
| 1 | 58 | 5.2 | 42 | 68–72 | 54–57 |
| 2 | 78 | 6.5 | 22 | 64–67 | 50–54 |
| 3 | 89 | 8.1 | 11 | 65–69 | 52–55 |

EXAMPLE 5

Production experiments for thin strips were carried out by using the same thin strip production apparatus as in Example 4. A ladle stopper had a circular cylindrical shape, a length of 900 mm and an outer diameter of 60 mm. It had a flower-shaped protrusion having a length of 60 mm at the distal end thereof as shown in FIG. 5(*d*). The y and Ao values shown in FIGS. 4(*a*), (*b*) and 5(*d*) were 13 mm and 1.5 $cm^2$, respectively. The other casting conditions were the same as those of Example 4.

As a result, thin strips having a width of about 120 mm and good properties could be obtained. Samples were collected from the resulting thin strips in the same way as in Example 1. The feed quantity of the molten alloy and the thickness of the thin strips were examined. As a result, it was found out that the feed quantity of the molten alloy was 62 to 64 kg/min and the thickness of the thin strips was 49 to 52 $\mu m$. Fluctuation of the feed quantity of the molten metal could not be observed from these data and fluctuations which would become a problem resulting from molten alloy feed quantity could not be observed.

It can be understood from the results given above that the supplying method of the molten alloy can supply the molten alloy at a feed quantity of not greater than 100 kg/min and, furthermore, substantially uniform during casting.

We claim:

1. A method for supplying molten alloy to a moving cooling substrate for producing an amorphous metal wire or an amorphous metal thin strip comprising:

providing a ladle for receiving said molten alloy with said ladle having a bottom wall defining a bottom surface of said ladle;

providing a long nozzle having a length and having an interior passage therein extending the length of said long nozzle, with the length of said interior passage extending in a perpendicular direction or inclined to the perpendicular direction, said long nozzle having one end connected to said bottom wall of said ladle for placing said interior passage of said long nozzle in fluid communication with said molten alloy in said ladle;

providing a ladle stopper disposed within said ladle, said ladle stopper having an outer wall surface parallel to said perpendicular direction;

providing a tundish below said ladle and in fluid communication with said long nozzle for receiving molten alloy from a distal end of said interior passage of said long nozzle;

supplying molten alloy from said ladle to said tundish by feeding molten alloy via said interior passage of said long nozzle;

supplying molten alloy from said tundish to said moving cooling substrate;

providing said ladle stopper with a distal end region having a length which is received by said interior passage of said long nozzle at said one end of said long nozzle;

defining a distance (y) as an overlap distance of the length of said distal end region of said ladle stopper received by said interior passage of said long nozzle during flow of said molten alloy through said interior passage;

defining an opening area (Ao) which is a sectional area for molten alloy flow provided by the opening area in said interior passage of said long nozzle resulting from receiving said distal end region of said ladle stopper;

defining a distance (Ln) which is distance from the bottom surface of said ladle to a minimum cross-sectional area of said interior passage of said long nozzle;

defining a distance (Lm) which is distance from the bottom surface of said ladle to a height of molten alloy in said ladle at start of feed of said molten alloy;

wherein when (y) is less than 0.1 mm, Ao is set to be 1.2 $cm^2$ and a ratio (Ln)/(Lm) is set be at least 1.5; and wherein when (y) is 0.1 to 200 mm, Ao is set to be 0.5 to 10 $cm^2$.

2. A method for supplying molten metal alloy according to claim 1 further comprising:

starting feed of molten alloy from said ladle to said tundish by moving said ladle stopper upward a selected distance thereby placing said ladle stopper in a selected position; and maintaining said ladle stopper in said selected position until feeding of said molten alloy is completed.

3. A method for supplying molten metal alloy according to claim 1 wherein:

said distal end region of said ladle stopper is a protrusion having a length of at least 5 mm and having an outer wall surface, with the outer wall surface of said protrusion being parallel to the perpendicular direction;

said interior passage of said long nozzle has an inner wall surface; and said outer wall surface of said protrusion does not contact said inner wall surface of said interior passage when said protrusion is received by said interior passage.

4. A method for supplying molten metal alloy according to claim 1 wherein:

said distal end region of said ladle stopper is a protrusion having a length of at least 5 mm and having an outer wall surface, with the outer wall surface of said protrusion being parallel to the perpendicular direction;

said interior passage of said long nozzle has an inner wall surface; and a portion of said outer wall surface of said protrusion contacts said inner wall surface of said interior passage when said protrusion is received by said interior passage.

5. A method for supplying molten metal alloy according to claim 1 wherein:

said interior passage of said long nozzle has an inner wall surface; and at least one obstacle to molten alloy flow is disposed on said inner wall surface of said interior passage.

* * * * *